US007378803B2

(12) United States Patent
Hendrix

(10) Patent No.: US 7,378,803 B2
(45) Date of Patent: May 27, 2008

(54) IGNITING PULSE BOOSTER CIRCUIT

(75) Inventor: Johan Leopold Victorina Hendrix, Eindhoven (NL)

(73) Assignee: Koninklijke Philips Electronics N. V., Eindhoven (NL)

( * ) Notice: Subject to any disclaimer, the term of this patent is extended or adjusted under 35 U.S.C. 154(b) by 392 days.

(21) Appl. No.: 10/533,230

(22) PCT Filed: Oct. 13, 2003

(86) PCT No.: PCT/IB03/04547

§ 371 (c)(1),
(2), (4) Date: Apr. 28, 2005

(87) PCT Pub. No.: WO2004/043118

PCT Pub. Date: May 21, 2004

(65) Prior Publication Data

US 2007/0145908 A1 Jun. 28, 2007

(30) Foreign Application Priority Data

Nov. 4, 2002 (EP) ..... 02079601

(51) Int. Cl.
*H05B 41/16* (2006.01)

(52) U.S. Cl. ..... 315/246; 315/209 CD; 315/276

(58) Field of Classification Search ..... 315/209 R, 315/219, 224–226, 209 CD, 246–24, 276, 315/291, DIG. 5
See application file for complete search history.

(56) References Cited

U.S. PATENT DOCUMENTS

| | | | | |
|---|---|---|---|---|
| 5,233,273 | A * | 8/1993 | Waki et al. | 315/224 |
| 5,729,097 | A * | 3/1998 | Holzer | 315/307 |
| 5,828,186 | A * | 10/1998 | Slegers et al. | 315/290 |
| 5,841,245 | A * | 11/1998 | Blom et al. | 315/289 |
| 5,892,332 | A * | 4/1999 | Drews et al. | 315/209 CD |
| 5,894,202 | A * | 4/1999 | Betz et al. | 315/289 |
| 6,104,147 | A * | 8/2000 | Nakamura et al. | 315/289 |
| 6,181,081 | B1 * | 1/2001 | Hirschmann et al. | 315/289 |
| 6,239,558 | B1 * | 5/2001 | Fujimura et al. | 315/307 |
| 2002/0070687 | A1 * | 6/2002 | Urakabe et al. | 315/291 |
| 2002/0130626 | A1 * | 9/2002 | Okamoto et al. | 315/219 |
| 2002/0175636 | A1 * | 11/2002 | Kawasaka et al. | 315/224 |

FOREIGN PATENT DOCUMENTS

EP 0891123 A1 1/1999

(Continued)

OTHER PUBLICATIONS

ISR, International Search Report PCT/IB2003/04547.

*Primary Examiner*—Thuy V. Tran
*Assistant Examiner*—Tung X Le

(57) ABSTRACT

A pulse booster circuit (10) comprises a first pulse transfer path (41) and a second pulse transfer path (42) extending between input terminals (11*a*; 11*b*) and output terminals (12*a*; 12*b*). A series arrangement of a capacitor (20and a first breakdown switch (13) is connected between said two input terminals (11*a*; 11*b*). A series arrangement of a second breakdown switch (14) and a primary winding (31) of a transformer (30) is connected in parallel to said capacitor (20). A first output winding (32)of said transformer (30) is incorporated in said first pulse transfer path (41), while a second output winding (33) of said transform (30) is incorporated in said second pulse transfer path (42).

20 Claims, 3 Drawing Sheets

FOREIGN PATENT DOCUMENTS

Figure 1:
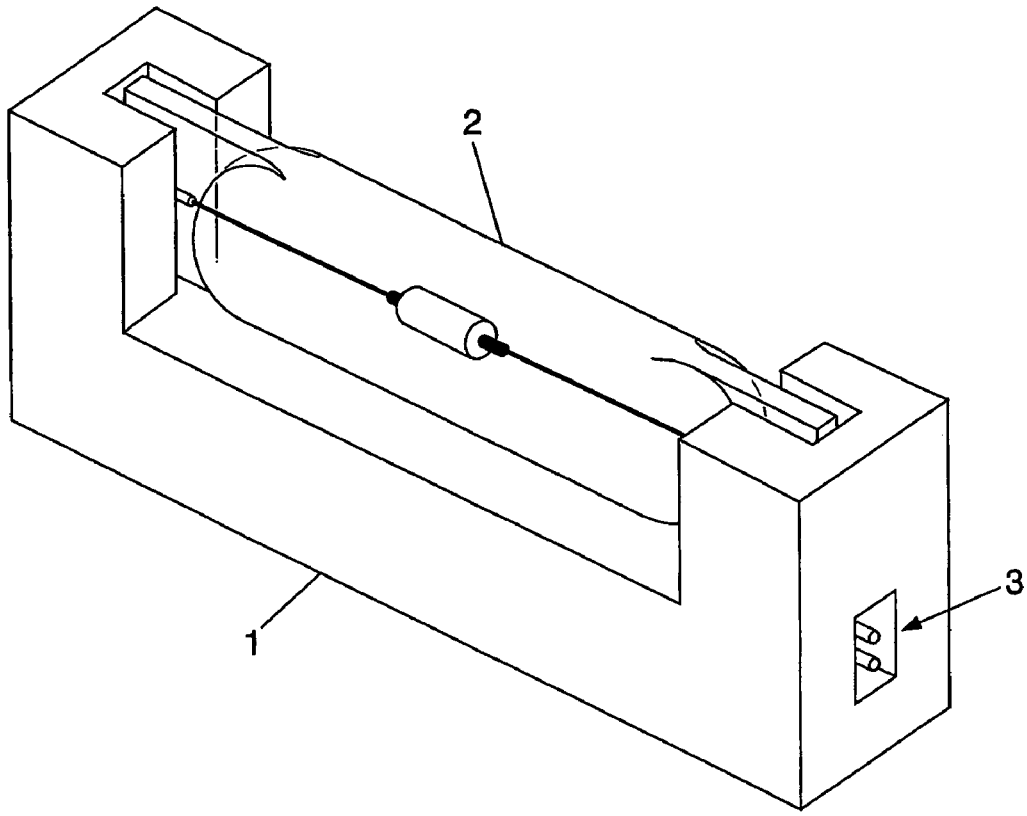

| | | | |
|---|---|---|---|
| EP | 0917411 | A1 | 5/1999 |
| EP | 0933977 | A2 | 8/1999 |
| JP | 03276594 | A | 12/1991 |
| JP | 03276595 | A | 12/1991 |
| JP | 03276596 | A | 12/1991 |
| WO | 9627278 | A1 | 9/1996 |
| WO | 0018194 | A1 | 3/2000 |

* cited by examiner

IGNITING PULSE BOOSTER CIRCUIT

This Application is a national phase Application Under 35 U.S.C. 371 claiming the benefit of PCT/IB03/04547 filed on Oct. 13, 1003, which has priority benefit based on European Patent Office Application No. 02079601.7 filed on Nov. 4, 2002.

The present invention relates in general to a device for driving a gas discharge lamp, more specifically a high-intensity discharge (HID) lamp.

Particularly, the present invention relates to a device for generating ignition pulses for a gas discharge lamp, more specifically a HID lamp.

To operate gas discharge lamps, additional lamp gear is required to stabilize the lamp (maintaining the nominal lamp voltage, current and power levels). To obtain this, conventional (electromagnetic) gear is the standard option. This involves a ballast choke to stabilize the lamp and an igniter to ignite the lamp. Nowadays, conventional gear is more and more replaced by electronic gear. This electronic gear combines the functions of lamp power control and ignition, often together with mains power factor correction, in one electronic circuit. Both types of ballasts provide a so called open circuit voltage to the lamp before ignition. In the case of conventional gear, this is the mains voltage, In electromagnetic gear, this is mostly a square wave voltage with a certain amplitude, e.g. 300 V. For ignition, high voltage pulses are superposed to this open circuit voltage by the igniter circuit. These pulses have to cause a breakdown in the gas discharge vessel. The open circuit voltage mentioned before has to be sufficiently high to provide take-over, this means sustaining a current in the ignited lamp. From this moment, the lamp power will rise to its nominal value (run-up). The ignition pulses as mentioned have a magnitude in the order of 3-5 kV.

A magnitude in the order of 3-5 kV for said ignition pulses has appeared sufficient to ensure ignition when a lamp is cold. However, HID lamps have the problem that they require a much stronger ignition pulse if they are still hot after they have been switched off (so-called hot restrike), typically in the order of 20 kV. Thus, a HID lamp needs to cool down after having been switched off, before such lamp can be switched on again using a conventional driver.

Alternatively, a driver might be designed for providing ignition pulses having a magnitude in the order of about 20 kV, but this makes such driver more expensive, larger and heavier although such high pulses for hot restrike are required or desired only in some applications. Further, the wiring between driver and lamp needs to be designed for 20 kV instead of 5 kV, which also adds to the costs.

Besides, there may be other reasons that a voltage pulse generated by lamp driving equipment appears to be insufficiently strong for igniting a gas discharge lamp, even when the lamp is cold. For instance, long wiring between pulse generator and lamp may increase cable capacitance thus reducing the voltage pulse height at the lamp side of the wiring. In conventional drivers, the energy content of such pulse goes wasted, and the driver generates a next ignition pulse of substantially the same magnitude, with a high probability that this new pulse will also appear to be insufficient, and its energy goes wasted, too.

It is a general objective of the present invention to provide a solution to these problems. Particularly, the present invention aims to provide a gas discharge lamp driving system capable of reliably igniting a gas discharge lamp, even when such lamp has problems with ignition in cold condition and or problems with hot restrike.

According to one aspect of the present invention, an ignition pulse booster circuit is provided, capable of receiving input voltage pulses of a first magnitude from a pulse generating driver and providing output voltage pulses of a second, higher magnitude. Advantageously, this booster circuit accumulates the energy of normal ignition pulses in cases where such normal ignition pulses do not succeed in igniting a discharge, and generates an output pulse of higher magnitude once it has accumulated sufficient energy. Thus, the energy contents of unsuccessful ignition pulses no longer goes wasted. Reliability of lamp ignition is improved, while the ignition pulse magnitude as generated by the driver can remain the same. The ignition booster can be added to the lamp driver system as desired/required.

According to another aspect of the present invention, a lamp holder for a gas discharge lamp is provided with an ignition pulse booster circuit. A driver, which may be a conventional, state of the art driver, may be arranged at a certain distance from the lamp holder, and the wiring between driver and lamp holder may be conventional, state of the art wiring. Only the wiring between the booster circuit output and the lamp, within the lamp holder, needs to be designed in conformity with 20 kV requirements.

Figure 2:
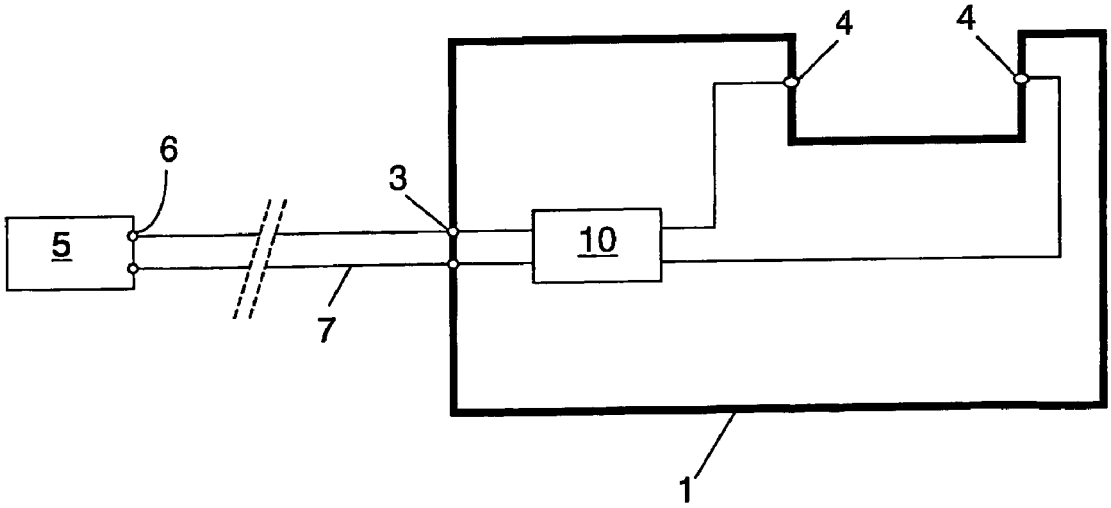
Figure 3A:
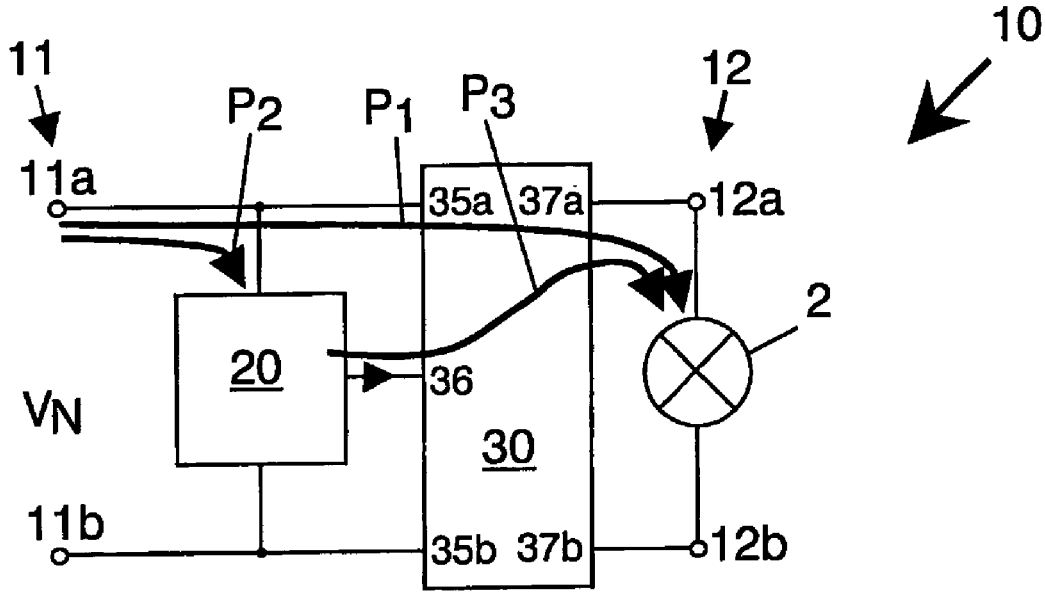
Figure 3B:
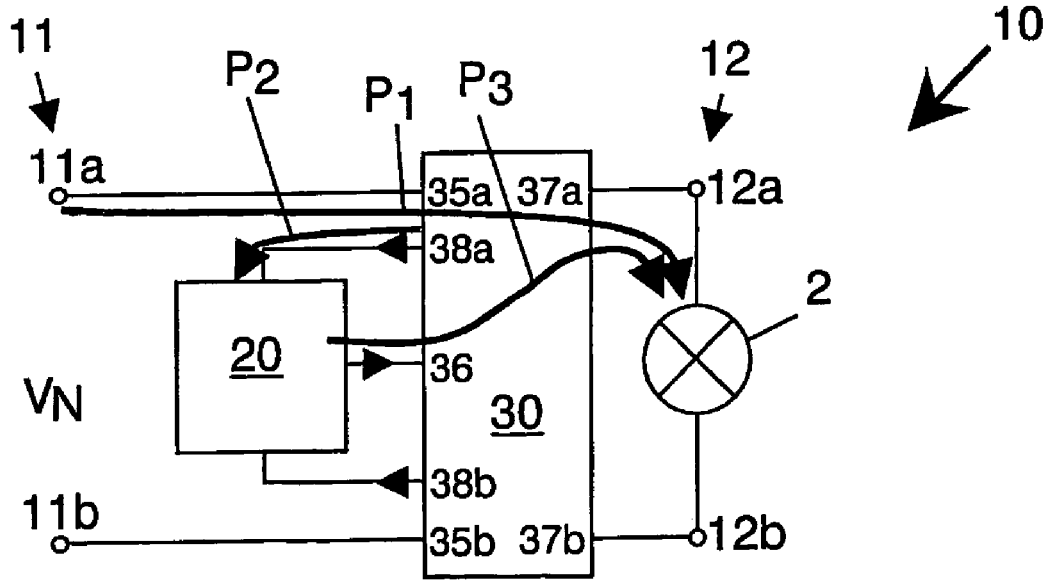
Figure 4:
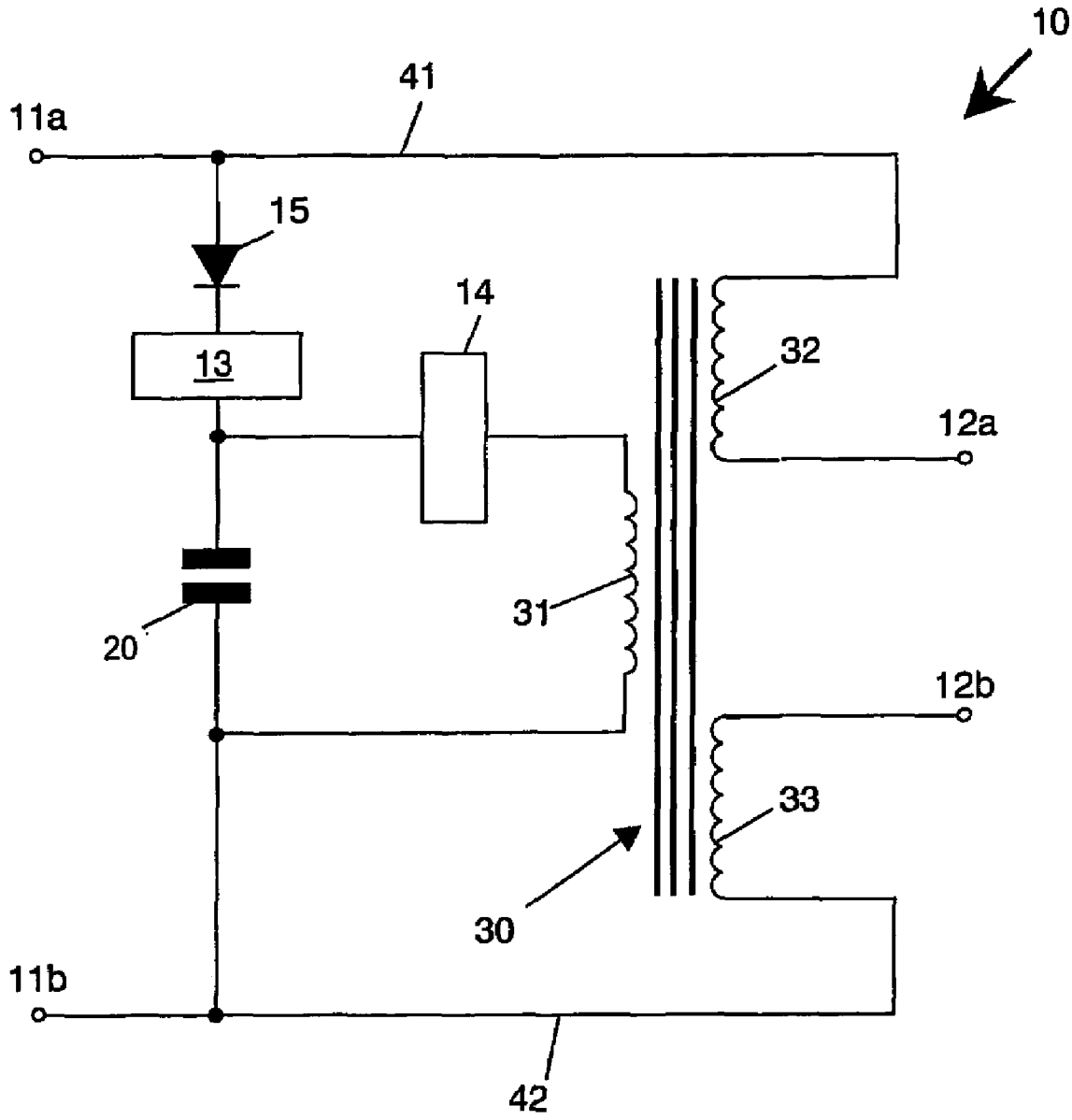

These and other aspects, features and advantages of the present invention will be further explained by the following description of a preferred embodiment of a gas discharge lamp driver according to the present invention with reference to the drawings, in which same reference numerals indicate same or similar parts, and in which:

FIG. 1 schematically shows a perspective view of a lamp holder with a gas discharge lamp;

FIG. 2 is a schematical block diagram of a lamp holder according to the present invention;

FIGS. 3A-B are schematical block diagrams explaining the operation basics of a pulse booster circuit according to the present invention;

FIG. 4 is a schematical block diagram illustrating a preferred embodiment of a pulse booster circuit according to the present invention.

In the following text, and in the drawings, individual terminals of an input or output will be distinguished by the addition of letters a or b to the corresponding reference numerals.

FIG. 1 schematically shows a perspective view of a lamp holder 1 for a gas discharge lamp 2. The lamp holder 1 has input terminals 3 for connection to a lamp driver, which may for instance be a conventional electronic ballast.

FIG. 2 is a schematical block diagram, showing the input terminals 3 of the lamp holder 1 connected to the output 6 of a lamp driver 5 via wiring 7, which may be conventional wiring designed for 5 kV requirements. The lamp holder 1 has output terminals 4 for coupling with a gas discharge lamp (not shown in FIG. 2). The lamp holder 1 is equipped with a pulse booster circuit 10, coupled between lamp holder input 3 and lamp holder output 4.

FIG. 3A is a schematical diagram of the pulse booster circuit 10 according to the present invention, for explaining the operation basics thereof. The pulse booster circuit 10 has an input 11 and an output 12 for connection to a lamp 2. The pulse booster circuit 10 receives normal lamp supply voltage $V_N$ at its input 11. This normal lamp supply voltage $V_N$ is outputted at the output 12 for feeding lamp 2. Under normal circumstances, this normal lamp supply voltage $V_N$ is sufficient to sustain the lamp. In the case that a lamp 2 needs to be ignited, this normal lamp supply voltage $V_N$ comprises a combination of lamp take-over voltage and additional lamp ignition pulses. If these additional lamp ignition pulses are sufficiently strong to ignite the lamp, such lamp ignition pulse is consumed by the gas discharge lamp 2 connected to the booster output 12, as indicated by arrow P1.

A key feature of the pulse booster circuit 10 is an energy buffer 20 having an input connected in parallel to the input 11, and a pulse generator 30 having an input 36 coupled to an output of the energy buffer 20 and having an output 37 coupled to the output 12 of the pulse booster circuit 10. Another input 35 of the pulse generator 30 is coupled to the input 11 of the pulse booster circuit 10. Normally, the pulse generator 30 transmits the ignitions pulses which, before ignition, are present in the lamp supply voltage $V_N$ received at its first input 35. Thus, normally, the energy content of any lamp ignition pulses in the normal lamp supply voltage $V_N$ is consumed by the gas discharge lamp 2 connected to the booster output 12, as indicated by arrow P1, as already mentioned.

If, for any reason, a lamp ignition pulse is not consumed by the gas discharge lamp 2, the energy of this lamp ignition pulse is substantially accumulated in the energy buffer 20, as indicated by arrow P2. When, after a number of such pulses, the accumulated energy in the energy buffer 20 reaches a certain predetermined level, the pulse generator 30 generates a high voltage pulse using the accumulated energy from the energy buffer 20 received at its second input 36, as indicated by arrow P3.

It is noted that, while the energy transfer path from energy buffer 20 to pulse generator 30 is shown as a single line, it may actually be implemented by two (or more) electrical conductors.

FIG. 3B is a schematical diagram of a modification of the pulse booster circuit 10 of FIG. 3A. The pulse generator 30 now has a second output 38 coupled to the input of the energy buffer 20. Normally, again, the pulse generator 30 transmits the ignitions pulses which, before ignition, are present in the lamp supply voltage $V_N$ received at its first input 35. Thus, normally, the energy content of the lamp ignition pulses in the normal lamp supply voltage $V_N$ is consumed by the gas discharge lamp 2 connected to the booster output 12, as indicated by arrow P1. If, for any reason, a lamp ignition pulse is not consumed by the gas discharge lamp 2, the energy of this lamp ignition pulse is transferred by the pulse generator 30 to the energy buffer 20, as indicated by arrow P2. When, after a number of such pulses, the accumulated energy in the energy buffer 20 reaches a certain predetermined level, the pulse generator 30 generates a high voltage pulse using the accumulated energy from the energy buffer 20 received at its second input 36, as indicated by arrow P3.

FIG. 4 schematically shows a circuit diagram illustrating a preferred embodiment of the pulse booster circuit 10. The pulse booster circuit 10 has input terminals 11*a*, 11*b* (indicated in common as input 11) and output terminals 12*a* and 12*b* (indicated in common as output 12). The normal lamp supply voltage $V_N$ is received at the input 11, and a gas discharge lamp 2 is to be connected to the output 12.

The pulse generator 30 is implemented as a pulse transformer 30, comprising an input winding 31, a first output winding 32 and a second output winding 33. The first output winding 32 is connected between a first input terminal 11*a* and a first output terminal 12*a*; the second output winding 33 is connected between a second input terminal 11*b* and a second output terminal 12*b*. Thus, a first pulse transfer path 41 is defined between first input terminal 11*a* and first output terminal 12*a*, and a second pulse transfer path 42 is defined between second input terminal 11*b* and second output terminal 12*b*. In normal operation, the normal lamp supply voltage $V_N$ passes these two transfer paths 41 and 42, without being substantially hindered by said two windings 32, 33, so that the normal lamp supply voltage $V_N$ is provided to the gas discharge lamp 2, as usual.

A property of the gas discharge lamp 2 is a lamp breakdown voltage $V_{LB}$ which is the lamp voltage at which breakdown occurs. Thus, the voltage applied to a lamp can not rise above the lamp breakdown voltage $V_{LB}$, at least not substantially. The actual value of this breakdown voltage $V_{LB}$ depends on circumstances. If the lamp is off and is to be ignited in cold condition, the corresponding breakdown voltage will be indicated as cold lamp ignition voltage $V_{LIC}$. If the lamp is off but still hot, and is to be re-ignited in hot condition, the corresponding breakdown voltage will be indicated as hot lamp ignition voltage $V_{LIH}$. In a HID lamp, the cold lamp ignition voltage $V_{LIC}$ is lower than the peak magnitude $V_P$ of the lamp ignition pulses in the normal lamp supply voltage $V_N$. Thus, for cold ignition under normal conditions, the peak magnitude $V_P$ of the lamp ignition pulses is capable of turning the lamp on, and the voltage at first input 11*a* will not rise above said cold lamp ignition voltage $V_{LIC}$.

The pulse booster circuit 10 further comprises a series combination of a buffer capacitor 20 and a first breakdown switch 13 and a diode 15, connected between said first input terminal 11*a* and said second input terminal 11*b*. The breakdown switch 13 is a device which is substantially non-conductive as long as the voltage over the switch terminals remains below a predetermined breakdown threshold level. As soon as the voltage over the switch terminals reaches said predetermined breakdown threshold level, the breakdown switch becomes substantially conductive, and remains substantially conductive as long as the voltage over the switch terminals remains above a predetermined blocking threshold level lower than said breakdown threshold level. A suitable example of a breakdown switch is a spark gap. Another suitable example is a SIDAC. Since a spark gap switch and a SIDAC switch are commonly known components, it is not necessary here to explain their design and operation in more detail.

The first breakdown switch 13 has a suitably selected breakdown threshold level $V_{BD1}$; in an exemplary embodiment, the value for $V_{BD1}$ is approximately 1600 V, which is below the specified lamp breakdown voltage. If an ignition pulse on input 11 has negative polarity, i.e. first input terminal 11*a* being negative with respect to second input terminal 11*b*, such pulse will be fully transferred to the output 12. However, if an ignition pulse on input 11 has positive polarity, i.e. first input terminal 11*a* being positive with respect to second input terminal 11*b*, the first breakdown switch 13 will break down when the voltage at first input terminal 11*a* reaches the value of 1600 V; thus, the transmitted ignition pulses are limited to 1600 V in such case. As a result, there is a chance that some lamps in some cases will not ignite anymore on the primary pulses. However, they will be ignited by 'booster' pulses, as will be explained.

When the first breakdown switch 13 breaks down, it closes a path from input 11 to the buffer capacitor 20, and the lamp ignition pulse voltage causes a charging current through the buffer capacitor 20. Thus, at least a part of the energy content of the lamp ignition pulse is stored in the buffer capacitor 20.

With each pulse thus charging the buffer capacitor 20, the voltage VC across the buffer capacitor 20 increases, depending on the energy content of the pulses and on the capacity of the buffer capacitor 20, as will be clear to a person skilled in the art.

The buffer capacitor 20 is connected in parallel to a series combination of a second breakdown switch 14 and the first winding 31 of the transformer 30. The second breakdown switch 14 has a suitably selected second breakdown threshold level $V_{BD2}$ lower than the first breakdown threshold level $V_{BD1}$, for instance 800 V. As soon as the voltage $V_C$ across the buffer capacitor 20 reaches this second breakdown threshold level $V_{BD2}$ of the second breakdown switch 14, the second breakdown switch 14 breaks down and closes a path from the buffer capacitor 20 to the first winding 31 of the transformer 30. The buffer capacitor 20 discharges over the first winding 31. As a result, a voltage pulse is induced in each of the output windings 32 and 33 of the pulse transformer 30. The magnitude of these voltage pulses depends on the breakdown threshold level $V_{BD2}$ of the second breakdown switch 14 and on the transformation ratio or winding ratio between input winding 31 and output windings 32, 33, as will be clear to a person skilled in the art.

In a suitable design, the voltage pulse induced in each output winding 32, 33 can have a peak value of 10 kV, such that the voltage across the lamp output terminals 12 can have a peak value of 20 kV. It is noted that, in such case, insulation measures need only to be taken for 10 kV to earth level and 20 kV between both wires. On the other hand, it is possible to use a transformer having only one output winding 32 or 33 coupled to only one output terminal 12*a* or 12*b*, respectively, but then, if it is desired to apply a voltage pulse having the same magnitude, insulation measures need to take account of the voltage level of 20 kV.

It is noted that, in normal lamp supply voltage $V_N$ on conventional gear, the lamp ignition pulses have a predetermined phase relationship with the AC main voltage. The output pulse provided by the pulse booster circuit 10 according to the present invention will have substantially the same phase relationship with the AC main voltage, since the breakdown of the second breakdown switch 14 will substantially coincide with a lamp ignition pulse of the normal lamp supply voltage $V_N$.

If, after a few pulses charging the buffer capacitor 20, the gas discharge lamp 2 does ignite on the normal lamp supply voltage $V_N$ without needing a boosted pulse from the buffer capacitor 20, the buffer capacitor 20 remains charged while the gas discharge lamp is burning. Normally, the buffer capacitor 20 will slowly discharge through parasitic resistances in the circuit. If it is desired that such discharge if the energy buffer is effected faster, it is possible to arrange a discharge resistor (not shown) in parallel to the buffer capacitor 20. This resistor should preferably have a relatively large resistance of about 10 Mohm or more.

The capacitance value of the buffer capacitor 20 is not critical; in general, a suitable value depends on circuit design (values of other components). A suitable value is, for instance, about 200 nF. If the capacitance value of the buffer capacitor 20 is chosen higher, more energy is available so that a higher and/or wider ignition pulse can be generated, but it will take more charging pulses to reach the breakdown voltage of the second breakdown switch 14.

In the embodiment illustrated in FIG. 4, a diode 15 is arranged in series with the first breakdown switch 13 and the buffer capacitor 20. In principle, such diode may be omitted in cases where a ballast generates positive ignition pulses only. However, some ballasts generate pulses with alternating polarity. In that case, the buffer capacitor being charged with a positive pulse would be discharged by the subsequent negative pulse; such discharging is prevented by the diode. An additional advantage is that, depending on the polarity of the primary pulses and on ignition booster circuit design, it is possible that half of the ignition pulses are transmitted at their full magnitude.

In the embodiment illustrated in FIG. 4, a single diode 15 is used to prevent discharging of the buffer capacitor. In that case, the negative ignition pulses are not used to charge the buffer capacitor 20. However, in stead of only one diode 15, it is possible to arrange a full diode bridge, such that positive as well as negative ignition pulses will be used for charging the buffer capacitor 20, as will be clear to a person skilled in the art. If the polarity of the input pulses changes with the take-over or supply voltage polarity, an advantage of a single diode may be that half of the pulses is topped by the switch while the other half of the pulses is fully available for the lamp.

Thus, the present invention provides a pulse booster circuit 10 comprising a first pulse transfer path 41 and a second pulse transfer path 42 extending between input terminals 11*a*; 11*b* and output terminals 12*a*; 12*b*. A series arrangement of a capacitor 20 and a first breakdown switch 13 is connected between said two input terminals 11*a*; 11*b*. A series arrangement of a second breakdown switch 14 and a primary winding 31 of a transformer 30 is connected in parallel to said capacitor 20. A first output winding 32 of said transformer 30 is incorporated in said first pulse transfer path 41, while a second output winding 33 of said transformer 30 is incorporated in said second pulse transfer path 42. Voltage pulses received at said input 11 are either used to ignite a lamp 2 or to charge the capacitor 20. As soon as the capacitor voltage has risen high enough, it discharges over the primary winding 31 of transformer 30, causing high voltage pulses being induced in the secondary windings 32, 33 of transformer 30.

If the gear performs below specification (e.g. caused by long wiring), the booster circuit will charge and a booster pulse will be fired and lamp ignition is assured. The booster thus assures ignition with extremely long wiring and under hot restrike conditions.

It should be clear to a person skilled in the art that the present invention is not limited to the exemplary embodiments discussed above, but that various variations and modifications are possible within the protective scope of the invention as defined in the appending claims.

In the above, the pulse booster circuit 10 is described as circuit accommodated in a lamp housing 1, which is a very advantageous embodiment. It is also possible that the pulse booster circuit 10 is implemented as a separate module, to be connected in a line from a driver to the lamp housing. It is also possible that the pulse booster circuit 10 is incorporated as an output stage in a driver for a gas discharge lamp. In all cases, the driver may for instance be implemented as a standard CuFe coil with igniter or an electronic ballast, as desired.

With respect to the design of the first breakdown switch 13, specifically its breakdown threshold level $V_{BD1}$, the following is noted. Firstly, the breakdown threshold level $V_{BD1}$ of the first breakdown switch 13 should be selected below the peak magnitude $V_P$ of the lamp ignition pulses present in the normal lamp supply voltage $V_N$, otherwise the first breakdown switch 13 would never break and the buffer 20 would not be charged. Secondly, the breakdown threshold level $V_{BD1}$ of the first breakdown switch 13 may be selected above said cold lamp ignition voltage $V_{LIC}$, in order to allow the lamp to ignite on the "normal" pulses. If the breakdown threshold level $V_{BD1}$ of the first breakdown switch 13 is below the actual value of said cold lamp ignition voltage $V_{LIC}$, the first breakdown switch 13 will always break down before the lamp does, and the lamp will always wait with ignition until it receives a boosted pulse. This may mean a slight delay before the lamp actually ignites. On the other hand, if the breakdown threshold level $V_{BD1}$ of the first breakdown switch 13 is selected relatively high, it may mean, in cases where the supply voltage is affected by, for instance, long wiring that the lamp ignition pulses present in the normal lamp supply voltage are not capable of breaking the switch 13.

The invention claimed is:

1. The pulse booster circuit, comprising:

an input comprising first and second input terminals for receiving input voltage pulses having a first magnitude;

an output comprising first and second output terminals;

an electric energy storage buffer having an input configured to be charged by at least part of said input voltage pulses;

a pulse generator having an input configured to be coupled to said energy storage buffer, the pulse generator means being configured to generate output voltage pulses having a second magnitude, using energy from said energy storage buffer; and a buffer charging circuit configured to sense a voltage difference between said first and second input terminals and to charge said energy storage buffer from said first and second input terminals in response to sensing said voltage difference exceeding a first predetermined threshold.

2. The pulse booster circuit according to claim 1, wherein said buffer charging circuit is configured to connect said energy storage buffer with at least one of said first and second input terminals in response to sensing said voltage difference exceeding said first predetermined threshold.

3. The pulse booster circuit according to claim 1, wherein said buffer charging circuit comprises a first breakdown switch coupled between said energy storage buffer and at least one of said first and second input terminals.

4. The pulse booster circuit according to claim 1, wherein said buffer charging circuit comprises a rectifier.

5. The pulse booster circuit according to claim 1, further comprising a buffer discharging circuit adapted to sense a voltage level of the energy storage buffer and to discharge said energy storage buffer at least partly into said input of said pulse generator in response to sensing said voltage level exceeding a second predetermined threshold.

6. The pulse booster circuit according to claim 5, wherein said a buffer discharging circuit is configured to connect said energy storage buffer with said pulse generator in response to sensing said voltage level exceeding said second predetermined threshold.

7. The pulse booster circuit according to claim 5, wherein said buffer discharging circuit comprises a second breakdown switch coupled between said energy storage buffer and said pulse generator.

8. The pulse booster circuit according to claim 5, wherein said second predetermined threshold is lower than said first predetermined threshold.

9. The pulse booster circuit according to claim 1, wherein said pulse generator comprises a transformer.

10. The pulse booster circuit according to claim 1, comprising:

a series arrangement of a first breakdown switch and a storage capacitor, coupled between said first and second input terminals;

a transformer having an input winding connected in series with a second breakdown switch, said series arrangement of second breakdown switch and transformer input winding being connected in parallel to said storage capacitor;

said transformer having a first output winding connected to said first output terminal.

11. The pulse booster circuit according to claim 10, wherein said transformer has a second output winding connected to said second output terminal.

12. A driver system for a gas discharge lamp, comprising a lamp current, an ignition pulses generator and a pulse booster circuit according to claim 1.

13. A lamp holder for a gas discharge lamp, comprising:

a driver input for connecting to a lamp driver system;

lamp connector terminals for electrical contact with a lamp received by said holder;

and a pulse booster circuit according to claim 1, accommodated within said holder, having its input connected to said driver input of said lamp holder and having its output connected to said lamp connector terminals of said lamp holder.

14. The pulse booster circuit, comprising:

an input comprising first and second input terminals for receiving input voltage pulses having a first magnitude;

an output comprising first and second output terminals;

an electric energy storage buffer having an input configured to be charged by at least part of said input voltage pulses;

a pulse generator having an input configured to be coupled to said energy storage buffer, the pulse generator being configured to generate output voltage pulses having a second magnitude, using energy from said energy storage buffer; and a buffer discharging circuit adapted to sense a voltage level of the energy storage buffer and to discharge said energy storage buffer at least partly into said input of said pulse generator in response to sensing said voltage level exceeding a predetermined threshold.

15. The pulse booster circuit according to claim 14, wherein said buffer discharging circuit is configured to connect said energy storage buffer with said pulse generator in response to sensing said voltage level exceeding said predetermined threshold.

16. The pulse booster circuit according to claim 14, wherein said buffer discharging circuit comprises a breakdown switch coupled between said energy storage buffer and said pulse generator.

17. The pulse booster circuit according to claim 14, wherein said second predetermined threshold is lower than said first predetermined threshold.

18. The pulse booster circuit, comprising:

an input comprising first and second input terminals for receiving input voltage pulses having a first magnitude;

an output comprising first and second output terminals;

an electric energy storage buffer having an input configured to be being charged by at least part of said input voltage pulses;

a pulse generator having an input configured to be coupled to said energy storage buffer, the pulse generator means being configured to generate output voltage pulses having a second magnitude, using energy from said energy storage buffer;

a series arrangement of a first breakdown switch and a storage capacitor, coupled between said first and second input terminals; and a transformer having an input winding connected in series with a second breakdown switch, said series arrangement of second breakdown switch and transformer input winding being connected in parallel to said storage capacitor;

said transformer having a first output winding connected to said first output terminal.

19. The pulse booster circuit according to claim 18, wherein said transformer has a second output winding connected to said second output terminal.

20. A lamp holder for a gas discharge lamp, comprising:

a driver input for connecting to a lamp driver system;

lamp connector terminals for electrical contact with a lamp received by said holder;

and a pulse booster circuit according to claim 18, accommodated within said holder, having its input connected to said driver input of said lamp holder and having its output connected to said lamp connector terminals of said lamp holder.

* * * * *